US005318095A

United States Patent [19]

Stowe

[11] Patent Number: 5,318,095

[45] Date of Patent: Jun. 7, 1994

[54] DIE CAST MAGNET ASSEMBLY AND METHOD OF MANUFACTURE

[76] Inventor: Michael W. Stowe, P.O. Box 402, Boyne City, Mich. 49712

[21] Appl. No.: 958,760

[22] Filed: Oct. 9, 1992

[51] Int. Cl.[5] ..... B22D 19/00

[52] U.S. Cl. ..... 164/112; 164/109

[58] Field of Search ..... 164/98, 109, 112, 322, 164/323

[56] References Cited

U.S. PATENT DOCUMENTS 4,088,177 5/1978 Armstrong et al. ..... 164/109

*Primary Examiner*—Paula A. Bradley
*Assistant Examiner*—Erik R. Puknys
*Attorney, Agent, or Firm*—Krass & Young

[57] ABSTRACT

A die cast, two pole, insulated magnet assembly and method of manufacture. A magnetic body of preferably ceramic ferrite material is sandwiched between two pole pieces such that each pole has a free end which projects beyond the magnetic body. The sandwiched pieces are then inserted into a female mold having a main mold cavity and a pair of opposed pole cavities formed therein to receive the projecting ends of the poles, thereby correctly aligning them. A metal sleeve is then inserted into the main mold cavity such that an annular space is created between the sandwiched magnet assembly and the sleeve. Molten zinc is then poured into the mold and sleeve to encapsulate the magnet except for the projecting ends of the poles. After the zinc has solidified, the assembly is removed from the mold.

6 Claims, 2 Drawing Sheets

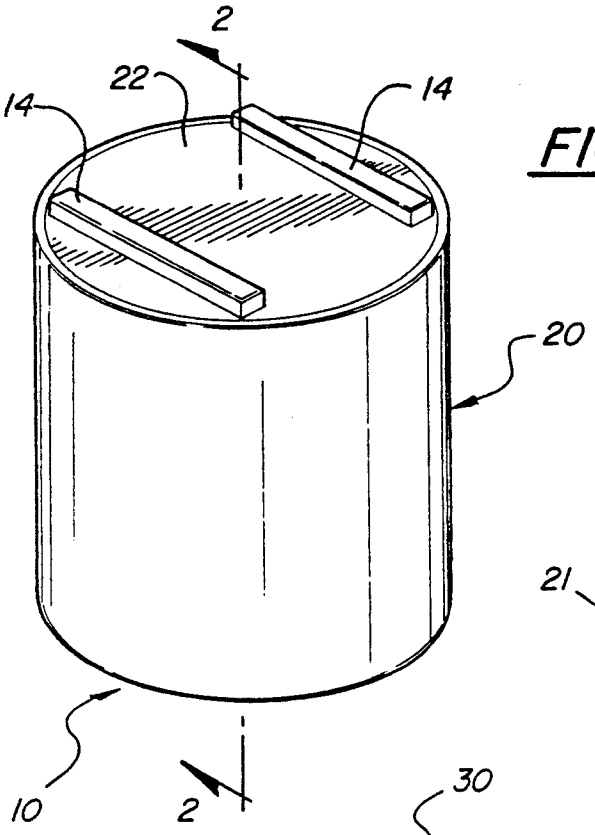
FIG-1
FIG-2
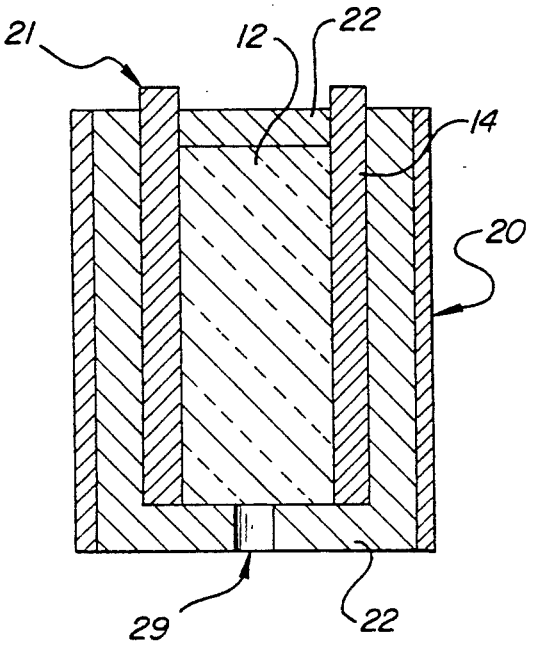
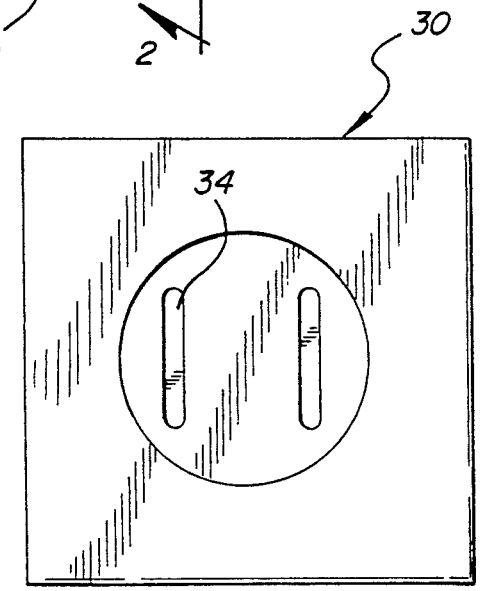
FIG-3A
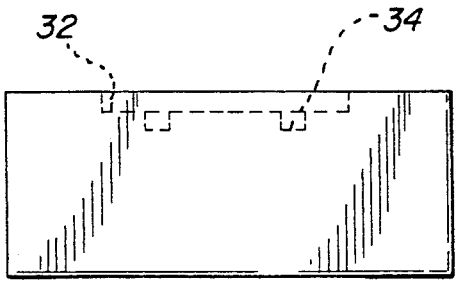
FIG-3B

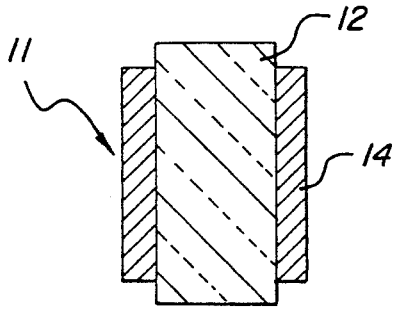
FIG-4A
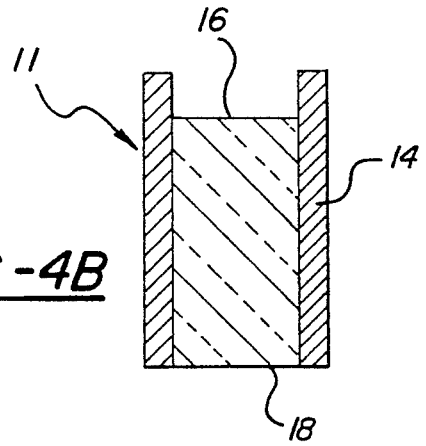
FIG-4B
FIG-5
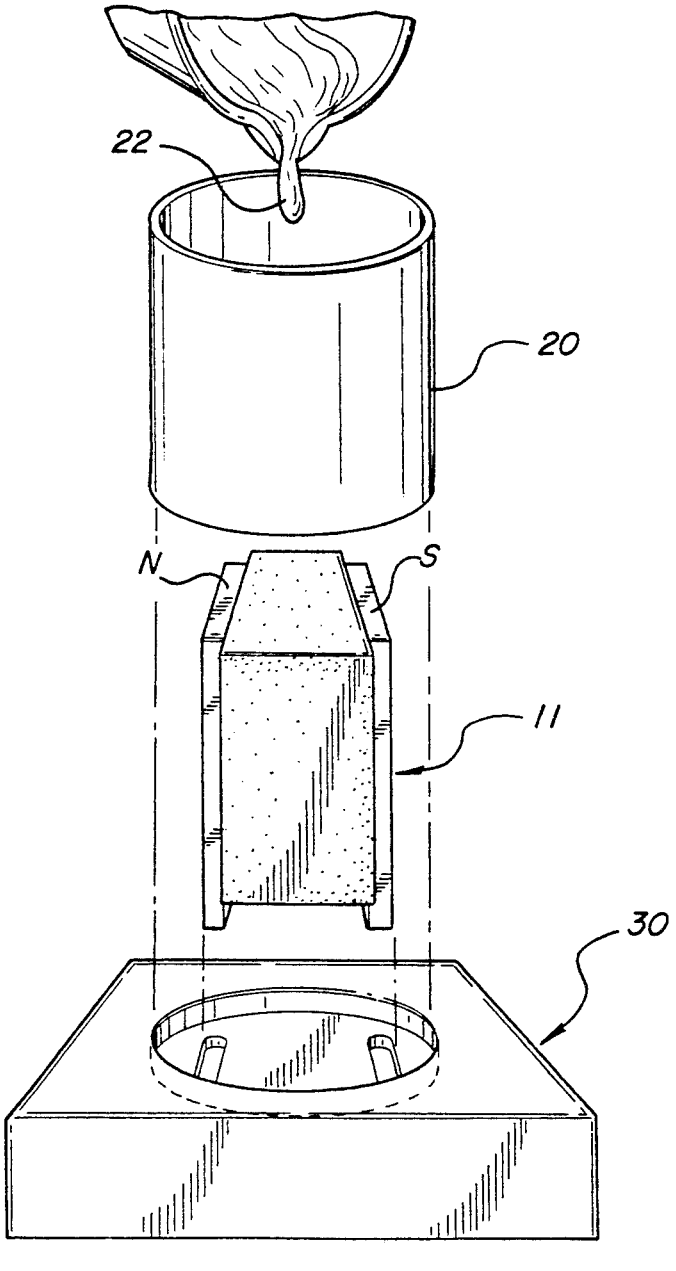

DIE CAST MAGNET ASSEMBLY AND METHOD OF MANUFACTURE

FIELD OF THE INVENTION

This invention relates to the field of encapsulated magnets, and, more particularly, to an insulated, two pole, ceramic magnet enclosed in a metallic sleeve.

BACKGROUND OF THE INVENTION

Two pole, insulated magnets are well known in the art, typically utilizing ferrite ceramic magnet material. Ceramic magnets of the fixed ferrite type have come into widespread usage within the past 50 years due to their excellent magnetic properties. Ceramic ferrite magnets are electrically non-conductive, hard, and much lighter in weight than magnets made of metallic alloys. They are also very resistant to demagnetization, and evidence very low eddy current losses. They are permanent magnets which have a very high coercive force values and high maximum energy products. Because of these properties, ceramic ferrite magnets are often incorporated into structures which require a large magnetic area but a relatively short magnetic length.

In the prior art method, a ceramic magnet is sandwiched between two ferrous poles. The sandwich assembly is then placed in a brass or aluminum cup such that the ends of the poles protrude beyond the edge of the cup. The cup is then filled with an epoxy or liquified plastic, which is allowed to harden, resulting in a finished magnet assembly.

Although such magnets are in widely available usage, the product does have its limitations, both in terms of production and of usage. In particular, the epoxy potting material and the brass or aluminum cup are not particularly amenable to machining, thus limiting the usefulness of the assembly.

In addition, the prior art process of manufacture is time consuming, requiring a cure cycle for the epoxy or liquified plastic; it may take as long as 15 minutes for the plastic or epoxy to cure so that the completed product can be handled, stored and moved. In addition, there are potential alignment problems when these products are manufactured by the prior art methods. In particular, it is difficult to ensure that the opposed magnetic pole pieces are correctly oriented in relation to the cup.

Despite the obvious disadvantages noted above, the prior art process of forming the magnetic assembly by encapsulating the magnetic sandwich in epoxy potting material is, so far as is known, virtually universally used in the industry at the present time.

Clearly, it would be desirable to have a two pole, insulated ceramic magnet assembly which does not include the brass sleeve and epoxy potting material of the prior art and is, thus, more amenable to machining and other shaping processes.

It would also be desirable to produce such a magnet by a method which is less time consuming, does not require a lengthy curing step, and which ensures that the magnetic pole pieces are in correct alignment with respect to the remaining elements of the magnetic assembly.

SUMMARY OF THE INVENTION

Disclosed and claimed herein is a die cast magnet assembly and method of manufacture. According to the method of the present invention, a body of ceramic ferrite magnetic material having top and bottom surfaces is sandwiched between two opposed, ferrous poles such that a free end of each pole extends beyond the top surface of the magnetic body. Together, the magnetic body and poles form a magnet sandwich.

The magnet sandwich is placed into a female mold including a cylindrical main cavity and two, opposed pole cavities formed in said main cavity. The two pole cavities are configured to receive the free ends of the poles therein. The main mold cavity has a cylindrical inner surface which is annularly spaced from the opposed pole cavities. The magnet sandwich is inserted into the mold cavity such that the free ends of the poles are received in the pole cavities.

A metal sleeve is then inserted into the main mold cavity. The sleeve has an outer diameter dimensioned to be in registry with the main mold cavity inner surface, and a length such that the sleeve extends for a distance above the bottom surface of the magnetic body.

A molten, non-magnetic, low melting point potting material, such as molten zinc, is poured into the mold and the sleeve until the surface of the liquid reaches the top of the sleeve. At this point, the potting material completely covers the bottom and top surface of the magnetic body. The potting material is allowed to cool and solidify to form a magnet assembly. The magnet assembly is then removed from the mold, for further handling and storage.

This method of manufacture eliminates the problem of aligning the poles with respect to the prior art brass or aluminum cup found in the prior art method of manufacture. In the present method, the poles are aligned by inserting them into the pole cavities of the mold, thus forcing the poles into the desired alignment with respect to the inner surface of the main body cavity. Insertion of the sleeve into the main mold cavity, thus, automatically aligns the opposed poles with respect to the sleeve in a preselected alignment pattern. Also, the die cast, two pole ceramic magnet assembly produced by the method manufacture claimed herein is easier to machine and shape since, typically, zinc is used as the potting material, and zinc is a highly machineable metal. Furthermore, a sleeve (typically formed of zinc or steel) instead of a cup is used, thereby resulting in a magnet assembly which can more easily be shaped on both its top and bottom surfaces. The process of the present invention is both faster and less expensive than the prior art process since the molten zinc solidifies within a matter of a few minutes, thus reducing the cycle time. Additionally, the sleeve may easily be cut from standard tubing, resulting in a considerable savings over the prior art brass or aluminum cups, which must be separately manufactured, typically, by casting.

BRIEF DESCRIPTION OF THE DRAWINGS

The following detailed description may best be understood by reference to the following drawings in which:

FIG. 1 is a perspective view of a die cast, two pole, insulated ceramic magnet assembly constructed according to the principles of the present invention;

FIG. 2 is a cross sectional view of the magnet assembly of FIG. 1 taken along lines 2—2;

FIGS. 3A and 3B, respectively, are top and front plan views of a mold suitable for use in the method of the present invention, with certain interior structures shown in phantom;

FIGS. 4A and 4B are, respectively, top and front plan views of a magnetic body sandwiched between two magnetic poles, illustrating one step of the method of the present invention; and FIG. 5 is an exploded view of the pouring step of the method of the present invention, illustrating the arrangement of the mold, magnet sandwich, and sleeve.

DETAILED DESCRIPTION OF THE PREFERRED EMBODIMENTS

Throughout the following detailed description, like reference numerals are used to reference the same element of the invention shown in multiple figures thereof. Referring now to the drawings, and in particular to FIGS. 1 and 2, there is shown a die cast, two pole, insulated ceramic magnet assembly 10 according to the present invention. The magnet assembly 10 comprises a body of ceramic ferrite magnetic material. While ceramic ferrite magnets can be formed of many materials, a particularly popular material is barium ferrite, having the empirical formula $BaFe_{12}O_{19}$. Barium ferrite materials have a coercive force of about 1600 oersteds and a residual induction of approximately 2000 gauss after the application of an applied field of 10,000 oersteds. These materials are also relatively inexpensive to manufacture.

Surrounding the body of magnetic material 12 are a pair of opposed magnetic poles 14 which are, typically, formed of a ferrous material such as a mild steel. As can best be seen in FIGS. 4A and 4B, the magnetic body 12 is sandwiched between the opposed magnetic poles such that a free end 21 of each pole 14 projects above the top surface 16 of the magnetic body 12. Together, the pair of poles 14 and the magnetic body 12 form a magnet sandwich 11.

Surrounding magnet sandwich 11 is a metal sleeve 20. Sleeve 20 is disposed around magnet sandwich 11 such that its longitudinal axis is transverse the top and bottom surfaces 16, 18 of the magnetic body 12. Sleeve 20 is sized such that magnet sandwich 11 may be encompassed by sleeve 20 so as to leave an annular space therebetween.

A non-magnetic, low melting point, castable potting material 22 encapsulates magnetic sandwich 11 save for the projecting ends 21 of poles 14. Thus, potting material 22 is disposed over the top and bottom surfaces 16, 18 of magnetic body 12, and within the annular space between magnet sandwich 11 and sleeve 20, as can best be seen in the cross sectional view depicted in FIG. 2. Optionally, tap holes 29 may be formed through potting material 22 to communicate with lower surface 18 of magnetic body 12.

In order to practice the method of the present invention to its best advantage, potting material 22 should be easily castable, have a relatively low melting temperature, and a quick solidification time. Suitable potting materials include, among others, tin, lead, bismuth, zinc and mixtures and alloys thereof. Preferably, zinc is selected as the potting material 22. It possesses the advantages of being relatively cheap, easy to cast, and has a melting point of only 420° C. In addition, it cools to solidification in only a few minutes. This greatly shortens the cycle time needed to manufacture the magnet assembly of the present invention. Additionally, zinc is very easy to machine and otherwise shape. However, it is harder than either lead or tin and does not so easily deform.

The method of manufacture of the magnet assembly of the present invention will now be described. As previously explained, magnetic body 12 is sandwiched between opposed magnetic poles 14 to create a magnet sandwich 11. The magnet sandwich 11 is then inserted into a female mold 30, depicted in FIGS. 3A and 3B, which includes a cylindrical main mold cavity 32 and a pair of opposed pole cavities 34. The pair of opposed pole cavities are formed in main mold cavity 32 and aligned with respect thereto so as to create a precise and correct alignment of the pole pieces 14 with respect to the sleeve 20 and the magnetic body 12 in the completed magnet assembly 10.

The magnet sandwich 11 is inserted into the mold 30 such that the free ends 21 of magnetic poles 14 are received by the pole cavities 34. This step places the poles 14 in correct alignment with each other and with respect to magnetic body 12. Sleeve 20 is then inserted into main mold cavity 32. Preferably, the outside diameter of sleeve 20 and the inside diameter of main body cavity 32 are such that sleeve 20 fits snugly within the mold 30. Because of this arrangement, sleeve 20 effectively forms the extended sides of the mold 30. Thus, main mold cavity 32 need only be deep enough to receive an end of sleeve 20 so that sleeve 20 is correctly aligned with respect to magnet sandwich 11. The alignment of the various components of the assembly during manufacturing is shown best in FIG. 5.

After the components are inserted into the mold 30, a molten potting material 22 such as zinc is poured from a ladle into mold 30 and sleeve 20. Thus, the potting material fills the annular space between the sleeve 20 and the magnet sandwich 11, as well as covering the top and bottom surfaces 16, 18 of magnetic body 12. It should be noted that the ends 21 of the poles 14 project for a greater distance beyond magnetic body 12 then the depth of the pole cavities 34 so as to form a space between top surface 16 and the bottom of the mold 30. Thus, potting material 22 will flow into the space to encapsulate the top surface 16 of the magnet sandwich 11, save for the projecting ends 21 of the poles which have been retained in the mold cavities 34. Furthermore, when the components are placed in the mold 30, sleeve 20 will extend for a slight distance beyond the bottom surface 18 of the magnetic body so that pouring the molten potting material 22 to the top of the sleeve 20 will cover and encapsulate the bottom surface 18 of the magnetic body 12. Thus, the magnet sandwich 11 will be completely encapsulated by potting material 22 save for the projecting ends 21.

The potting material 22 is allowed to cool to solidification, the resultant magnet assembly 10 is then removed from mold 30, and the part is, typically, placed in a water tank to cool.

Magnetic poles 14 are, preferably, formed of a mild steel, and are sheared to size by a press. The sleeve 20 is, typically, formed of No. 3 zinc or SAE 903 or 925 steel tubing of suitable diameter. It is snap cut to the correct length in volume. The ceramic ferrite magnetic material is preferably cut on a diamond saw. The magnets used in the present invention are fully magnetized at assembly.

Other variations and arrangements of the assembly of the present invention may occur to one skilled in the art who has the benefit of the teachings of the present invention. Furthermore, variations in the manufacturing steps may also be apparent to one so adept. However, such modifications and variations are considered to be within the scope of the present invention. While the article and method claimed herein have been described with reference to certain embodiments and exemplifications thereof, the scope of the present invention is not intended to be so limited, but, solely by the claims appended hereto and reasonable equivalents thereof.

I claim:

1. A method of manufacturing a two pole, insulated, ceramic magnet assembly comprising the steps of:

sandwiching a body of magnetic material having top and bottom surfaces between two opposed magnetic poles such that a free end of each pole extends beyond said top surface to form a magnet sandwich;

inserting said magnet sandwich into a female mold cavity having a cylindrical main cavity and two opposed pole cavities formed in said main cavity, and configured to receive said free ends of said poles therein, said main mold cavity having a surface annularly spaced from said pole cavities such that said free ends of said poles are received in said pole cavities;

inserting a metal sleeve into said main mold cavity, said sleeve having an outer diameter dimensioned to be in registry with said main mold cavity surface and a length such that said sleeve extends for a distance above said bottom surface of said magnetic body;

pouring a molten, non-magnetic, low melting point potting material into said mold and said sleeve;

allowing said potting material to cool and solidify to form a magnet assembly; and removing said assembly from said mold.

2. The method of claim 1 comprising the further step of selecting the potting material from a group consisting of lead, tin, bismuth, zinc, low melting steel alloy, or mixtures thereof.

3. The method of claim 1 wherein the step of pouring a potting material into said mold and said sleeve comprises the step of pouring molten zinc into said mold and said sleeve.

4. The method of claim 1 wherein the step of inserting a metal sleeve into the main mold cavity comprises the step of inserting a zinc sleeve into said cavity.

5. The method of claim 1 wherein the step of sandwiching the body of magnetic material between two opposed poles comprises the step of inserting a magnetic body formed of ceramic finite magnetic material therein.

6. The method of claim 1 comprising the further step of forming said magnetic poles from mild steel.

* * * * *